US006253044B1

(12) United States Patent
Shoji et al.

(10) Patent No.: US 6,253,044 B1
(45) Date of Patent: Jun. 26, 2001

(54) IMAGE FORMING APPARATUS HAVING BLADE CLEANING DEVICE APPLIED THERETO, AND PROCESS CARTRIDGE

(75) Inventors: Takeo Shoji, Shizuoka-ken; Takashi Hibi, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/492,111

(22) Filed: Jan. 27, 2000

(30) Foreign Application Priority Data

Jan. 28, 1999 (JP) ..... 11-019913

(51) Int. Cl.[7] ..... G03G 21/16; G03G 21/00
(52) U.S. Cl. ..... 399/111; 399/347
(58) Field of Search ..... 15/1.51, 256.5, 15/256.51, 308; 399/107, 109, 111, 116, 159, 161, 343, 344, 345, 346, 347, 350, 351, 353, 357; 430/97, 125

(56) References Cited

U.S. PATENT DOCUMENTS

| | | | | |
|---|---|---|---|---|
| 5,095,335 | | 3/1992 | Watanabe et al. . | |
| 5,126,800 | | 6/1992 | Shishido et al. . | |
| 5,148,639 | * | 9/1992 | Sakai et al. | 51/328 |
| 5,331,372 | | 7/1994 | Tsuda et al. . | |
| 5,455,665 | | 10/1995 | Baba et al. . | |
| 5,470,635 | | 11/1995 | Shirai et al. | 428/131 |
| 5,565,961 | | 10/1996 | Shoji et al. . | |
| 5,608,509 | | 3/1997 | Shirai et al. | 399/351 |
| 5,667,926 | * | 9/1997 | Maruyama et al. | 430/97 |
| 5,671,475 | * | 9/1997 | De Cock et al. | 399/347 |
| 5,828,928 | | 10/1998 | Sasago et al. | 399/111 |
| 5,835,818 | | 11/1998 | Hoshika et al. | 399/26 |
| 5,884,124 | | 3/1999 | Karakama et al. | 399/123 |

FOREIGN PATENT DOCUMENTS

| | | |
|---|---|---|
| 62-182785 | 8/1987 | (JP) . |
| 8-95258 | 4/1996 | (JP) . |
| 10-340027 | 12/1998 | (JP) . |
| 11-2910 | 1/1999 | (JP) . |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An electrophotographic image forming apparatus includes an electrophotographic photosensitive body for forming electrostatic latent images thereon; a charging device structured with an electrode member in contact with the photosensitive body for forming the latent images on the photosensitive body; a cleaning device having a cleaning blade to rub and remove toner from the surface of the photosensitive body by enabling the leading edge thereof to abut thereupon in a counter to the moving direction of the photosensitive body; a developing device for developing with toner the latent images formed on the photosensitive body; and a surface roughing device arranged within a cleaning area to which the cleaning blade to abuts, outside the developing area of the developing means to carry out development, and further, arranged on the downstream side of the charging device observed in the moving direction of the photosensitive body, but on the upstream side of the cleaning blade to abut upon the photosensitive body for making the surface thereof rough, hence making it possible to prevent the cleaning blade from being turned up along the movement of the photosensitive body when the blade removes unwanted toner from the surface of the photosensitive body.

12 Claims, 4 Drawing Sheets

IMAGE FORMING APPARATUS HAVING BLADE CLEANING DEVICE APPLIED THERETO, AND PROCESS CARTRIDGE

BACKGROUND OF THE INVENTION

1. Field of the Invention

The present invention relates to an image forming apparatus which uses an electrophotographic process, and which is provided with a cleaning blade to rub and remove toner or the like adhering to a surface of an image bearing member. The invention also relates to a process cartridge which is detachably mountable on such image forming apparatus.

2. Related Background Art

FIG. 5 is a schematic view which shows the conventionally used apparatus, in which several image formation means of an image forming apparatus that uses the electrophotographic process are compactly arranged to be of cartridge type. In FIG. 5, a reference numeral 1 designates a photosensitive drum serving as an image bearing member; 2 denotes a charging roller using the charging electrodes that is in contact with the surface of the photosensitive drum 1 for charging the photosensitive drum 1 uniformly; 5 denotes developing means for forming toner images by enabling toner to adhere to the electrostatic latent images formed on the surface of the photosensitive drum 1; and 8 denotes cleaning means for removing and collecting the toner remaining on the surface of the photosensitive drum 1. The photosensitive drum 1, the charging roller 2, the developing means 5, the cleaning means 8, and others are integrally supported by a housing 9 to be arranged in the form of a cartridge, thus structuring a process cartridge 11 altogether.

The developing means 5 rotates in the direction indicated by an arrow b, which is provided with a development sleeve 3 that carries toner, and a developing blade 4, which regulates the thickness of the toner layer on the development sleeve 3.

Below the photosensitive drum 1, a transfer roller 10 is arranged as transfer means for electrostatically transfer the developed images on the photosensitive drum 1 to a transfer material by charging the transfer material.

The transfer material P, which bears the non-fixed toner image transferred by the transfer roller 10, is conveyed to a fixing device (not shown), in which the non-fixed toner image is fixed by the application of heat and pressure by fixing means.

The cleaning means 8 is provided with a cleaning blade 6, which is supported by a supporting member 13, for scraping off the remaining toner after transfer from the photosensitive drum 1, and a receiving sheet 7 for catching and collecting the remaining toner after transfer thus scraped off. Also, on each of both end portions of the cleaning blade 6, a blade edge seal (not shown), such as foaming poly urethane, is arranged between the blade 6 and a container of the cleaning means 8.

Usually, the urethane rubber is often used for the cleaning blade 6, because the urethane rubber has a good durability.

Also, the urethane rubber has a high contactness and a high toner scraping capability, but its sliding performance is not good against the member with which the urethane rubber is in contact due to such excellent a contactness. Also, when the photosensitive drum 1 rotates, the cleaning blade 6 receives a force in the direction indicated by an arrow F in FIG. 5. However, since the cleaning blade is in contact with the surface of the photosensitive drum 1 in a direction counter to a rotational direction of the photosensitive drum 1, there is a problem of the so-called "blade turning up phenomenon" resulting from an evagination of an edge portion of the blade 6 turned in the direction indicated by the arrow F along with the rotational movement of the photosensitive drum 1 if the friction force becomes too strong between the photosensitive drum 1 and the blade 6.

Here, therefore, in order to deal with such problem, there is adopted a method for enhancing the lubricity by coating fine particles of silicon resin or fluoric particles as a lubricant on the contact portion of the eleaning blade 6 with the photosensitive drum 1. However, the lubricant is peeled off from the cleaning blade 6 and gradually reduced when the blade is used for a long time. Therefore, it is impossible to maintain the preventive effect of the blade turning up for a long time.

The following method is also known as another example of dealing with a problem of this kind.

Usually, the surface of the photosensitive drum 1 is almost in a mirror-like state due to its manufacture. Therefore, the cleaning blade 6 tends to be closely in contact with the photosensitive drum 1 to create an extremely large friction resistance. However, within a range that does not create any problem with respect to the image formation, the surface of the photosensitive drum may be made rough so as to reduce the area of contact between the cleaning blade 6 and the photosensitive drum 1. Then, the friction force can be reduced accordingly. In such a manner, the surface of the photosensitive drum 1 is made rough to a certain extent to prevent the friction force between the photosensitive drum 1 and the blade 6 from becoming excessive.

For example, in the specifications of Japanese Patent Application Laid-Open No. 08-095258 and Japanese Patent Application Laid-Open No. 11-002910, it is disclosed that the surface of the photosensitive drum 1, which is in contact with near the end portion of the blade, is made rougher than the surface of the central portion of the photosensitive drum 1.

This treatment is required in order to prevent noises from being generated by the vibrations of the cleaning blade 6, which is in contact with the end surface of the photosensitive drum 1, and also, to prevent the blade 6, from being turned up, because the side end, portion of the cleaning blade 6 which is a free end is easier to be turned up than the central portion thereof. In other words, the surface of the photosensitive drum 1 is made rough to a certain extent to reduce the area of contact between the cleaning blade 6 and the photosensitive drum 1 to make the friction force smaller. In this way, it becomes possible to prevent the friction force between the photosensitive drum 1 and the blade 6 from becoming excessive.

Further, in the specification of Japanese Patent Application Laid-Open No. 10-340027, a polishing member is disclosed as the one used for making the surface roughness greater on the end portion of the image bearing member 1 than that on the central portion thereof by making the polishing properties different for the polishing portion at the end where the end of the image bearing member 1 is polished in the width direction and the polishing portion in the center where the central portion of the image bearing member is polished.

For this disclosure, too, the polishing member is provided on purpose to make the surface of the photosensitive drum rough as is in the case described earlier, because the side end portion of the cleaning blade 6 is free, and for that matter, it is easier to be turned up than the central portion.

Further, in the specification of Japanese Patent Application Laid-Open No. 62-182785, it is disclosed that is developed on the ends of the photosensitive drum 1 in the wide direction of the sheet so that the talc is removed together with the toner from the surface of the photosensitive drum 1 or that the toner polishes the surface of the photosensitive drum 1 to remove the talc from the surface of the photosensitive drum 1 to avoid a smeared image.

This is the method for polishing the surface of the photosensitive drum 1 within the area of the development, which is evidently different from the means for polishing the surface of the photosensitive drum 1 outside the area of the development in accordance with the present invention.

However, there are problems encountered as given below as to such methods as disclosed in the specifications of Japanese Patent Application Laid-Open No. 08-095258 and Japanese Patent Application laid-Open No. 11-002910 that the blade turning up and others are prevented by making the surface of the photosensitive drum 1 rough in advance.

When the photosensitive drum is used for a long time, the surface thereof is ground gradually, and the surface roughness becomes smaller than that initially provided. Then, there is a possibility that the end portion of the blade 6 turns up eventually.

In other words, only with the roughness provided for the surface in advance, the blade turn up is encountered inevitably if the photosensitive drum is used for a long time.

Also, the method, in which the roughness of the end portion is made greater by polishing the surface of the photosensitive drum 1 by use of the polishing member as disclosed in the specification of Japanese Patent Application Laid-Open No. 10-340027, makes it possible to maintain the roughness of the end portion to a certain extent, and continuously prevent the blade 6 from being tuned up. However, if contact charging means 2 is adopted as in the case of the present invention, the charging defect may take place eventually, because polished particles are allowed to adhere to the contact charging means 2 when the polishing member is positioned on the downstream side of the cleaning means in the operating direction of the photosensitive drum 1.

Also, since the charging member 2 is the charging roller 2, which serves as a contact charging member, this charging roller is pressed by springs (not shown) on both end portions so that it is in contact with the surface of the photosensitive drum 1. Then, this charging roller is rotated by the rotation of the photosensitive drum 1. In other words, both end portions are higher than the central potion. Therefore, the surface material of the charging roller 2 is rubbed and transferred to the surface of the photosensitive drum 1, although in a limited quantity. This may take place particularly on both end portions. This condition makes it difficult for the surface of the photosensitive drum 1 to slide easily, and leads to inviting the turning up of the blade 6 eventually.

Then, on the locations other than the end portions, the transfer roller 10 is in contact with the surface of the photosensitive drum 1 in particular. The transfer roller 10 itself cleans the surface of the photosensitive drum 1. Further, on the inner side thereof, the toner images and the transfer material P are in engagement with cleaning. In other words, sliding becomes more difficult particularly only on the surface of the photosensitive drum 1 where the charging roller 2 is in contact on the outer side than the portion where the transfer roller 10 is in contact. This motivates the turning up of the blade.

SUMMARY OF THE INVENTION

With a view to solving the aforesaid problems, the present invention is designed. It is an object of the invention to provide a structure that makes it possible to reduce the turning up phenomenon of the cleaning blade even when the device is used for a long time.

Also, it is another object of the invention to provide an image forming apparatus and a process cartridge provided with cleaning means capable of reducing such turning up phenomenon of the cleaning blade.

In order to achieve the objects described above, the electrophotostatic image forming apparatus of the present invention comprises an electrophotographic photosensitive member on which an electrostatic latent image is formed; a charging device structured with an electrode member being in contact with the photosensitive member for forming the latent image on the photosensitive member; a cleaning device having a cleaning blade for use of cleaning to rub and remove toner from the surface of the photosensitive member by contacting the leading edge of the cleaning blade to the photosensitive member in a direction counter to the moving direction of the photosensitive member; a developing device for developing with toner the latent image formed on the photosensitive member; and a surface roughing device arranged in an inner area within the cleaning area against which the cleaning blade abuts, and in an outer area outside the developing area in which the developing device carries out development, and on the downstream side of the charging device in the moving direction of the photosensitive member, and on the upstream side of the cleaning blade to abut against the photosensitive member for making the surface of the photosensitive member rough.

Also, a process cartridge of the present invention, which is detachably mountable to an electrophotographic image forming apparatus, comprises an electrophotographic photosensitive member on which an electrostatic latent image is formed; a charging device structured with an electrode member being in contact with the photosensitive member to charge the photosensitive member for forming the electrostatic latent image on the photosensitive member; a cleaning device having a cleaning blade for use of cleaning to rub and remove toner from the surface of the photosensitive member by contacting the leading edge of the cleaning blade to the photosensitive member in the counter direction to the moving direction of the photosensitive member; a surface roughing device being in contact with the photosensitive member in an inner area within the cleaning area against which the cleaning blade abuts and in an outer area outside the developing area in which the developing device carries out development, and arranged on the downstream side of the charging device in the moving direction of the photosensitive member, and on the upstream side of the cleaning blade to abut against the photosensitive member for making the surface of the photosensitive member rough; and a frame for integrally supporting the photosensitive member, the charging device, the cleaning device, and the surface roughing device.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Figure 1:
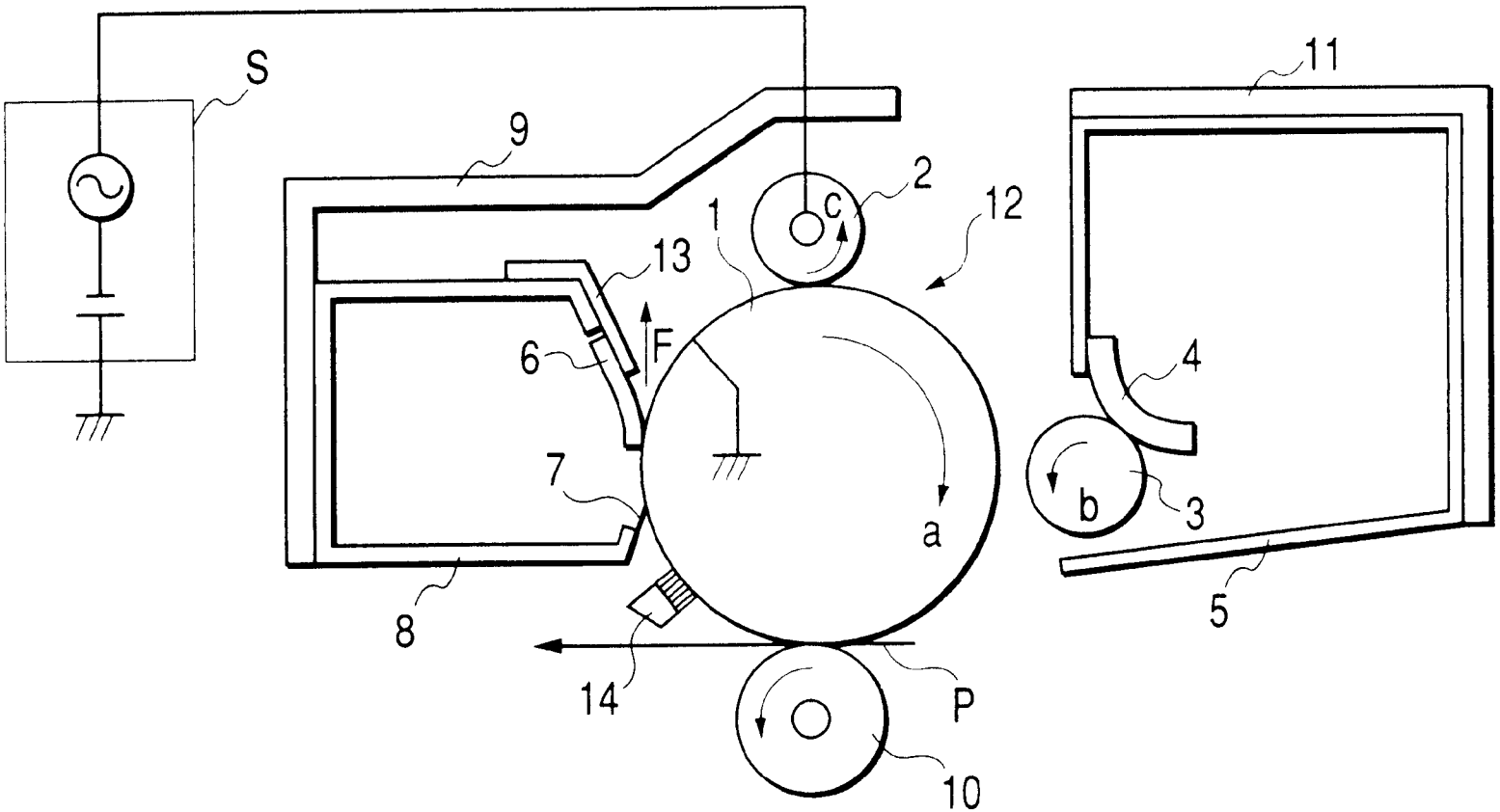
FIG. 1 is a schematic view which shows a fundamental apparatus structure of an image forming apparatus used in the present invention.
Figure 5:
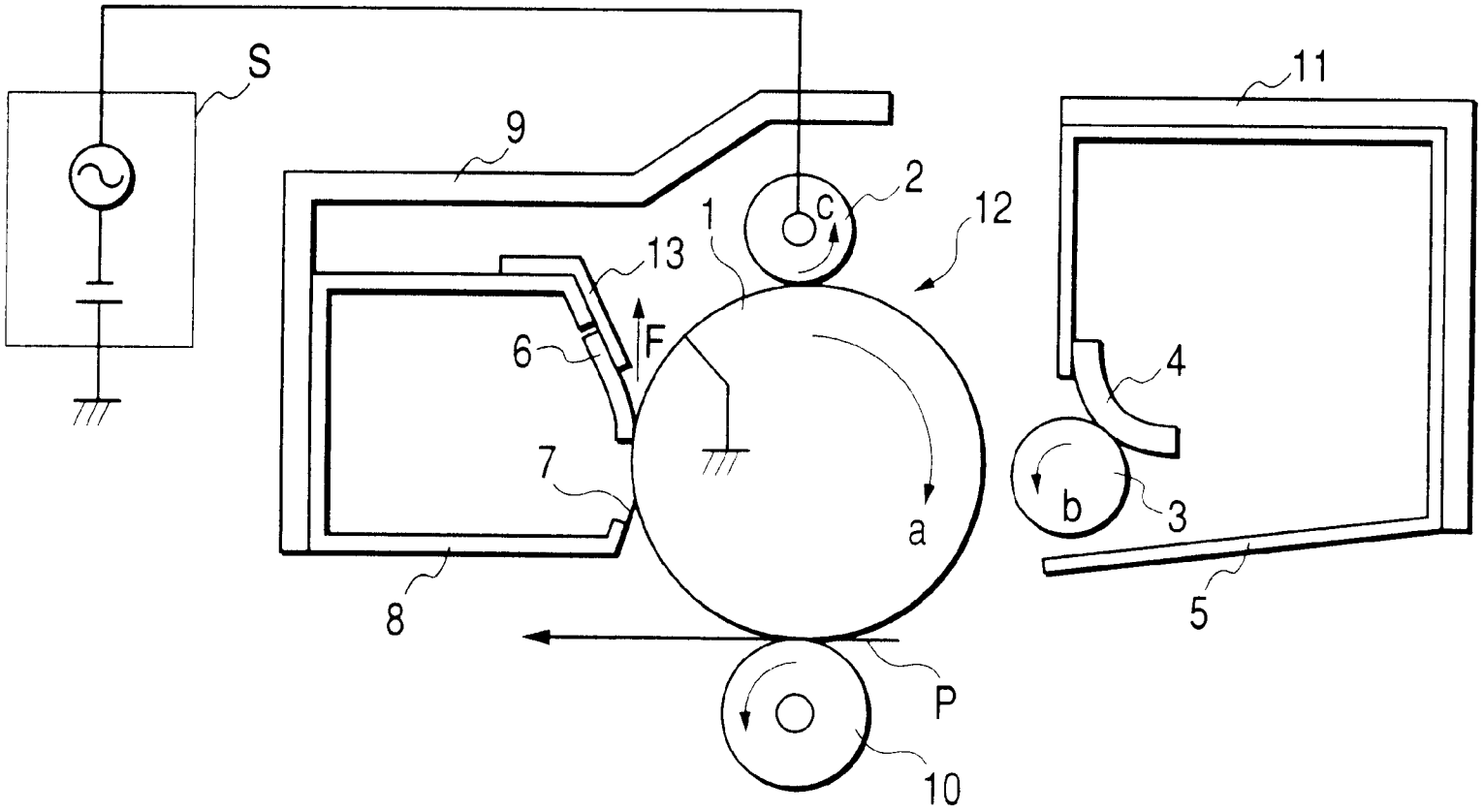
FIG. 5 is a schematic view that shows a conventional image forming apparatus.

FIG. 1 is a view that schematically shows a structure of an image forming apparatus in accordance with an embodiment of the present invention. The structure is the same as the one shown in FIG. 5.

For the image forming apparatus, a photosensitive drum 1 is rotatably supported to serve as an image bearing member, which is an electrophotographic photosensitive member. The photosensitive drum 1 is driven by driving means (not shown) to rotate in a direction indicated by the arrow a.

There are arranged around the photosensitive drum 1 along the direction in which the photosensitive drum 1 rotates, a charging roller 2, which serves as a contact charging electrode to charge the surface of the photosensitive drum 1 to the uniform potential; developing means 5 for applying toner to an electrostatic latent image formed on the surface of a photosensitive drum 1 for a formation of toner image; and cleaning means 8 for scraping off the remaining toner on the surface of the photosensitive drum 1 by use of a cleaning blade 6 and removing and collecting the remaining toner, among some others.

Then, the photosensitive drum 1, the charging roller 2, the developing means 5, the cleaning means 8, and others are integrally supported in the housing 9 and compactly arranged as a cartridge, thus structuring a process cartridge 11.

The process cartridge 11 is easily and detachably mountable on the image forming apparatus. In a state in that the process cartridge 11 is mounted, a transfer roller 10 is arranged below the photosensitive drum 1, The transfer roller 10 serves as a transfer charging electrode that transfers the toner image on the surface of the photosensitive drum 1 to a transfer material P. To this transfer roller 10, a transfer bias voltage is applied, thus forming a transfer electric field between the photosensitive drum 1 and the transfer material P.

The transfer material P, which bears a non-fixed toner image thereon when passing through the transfer roller 10, is conveyed to fixing means, which is not shown, and fixed by application of heat and pressure exerted by the fixing means.

Figure 2:
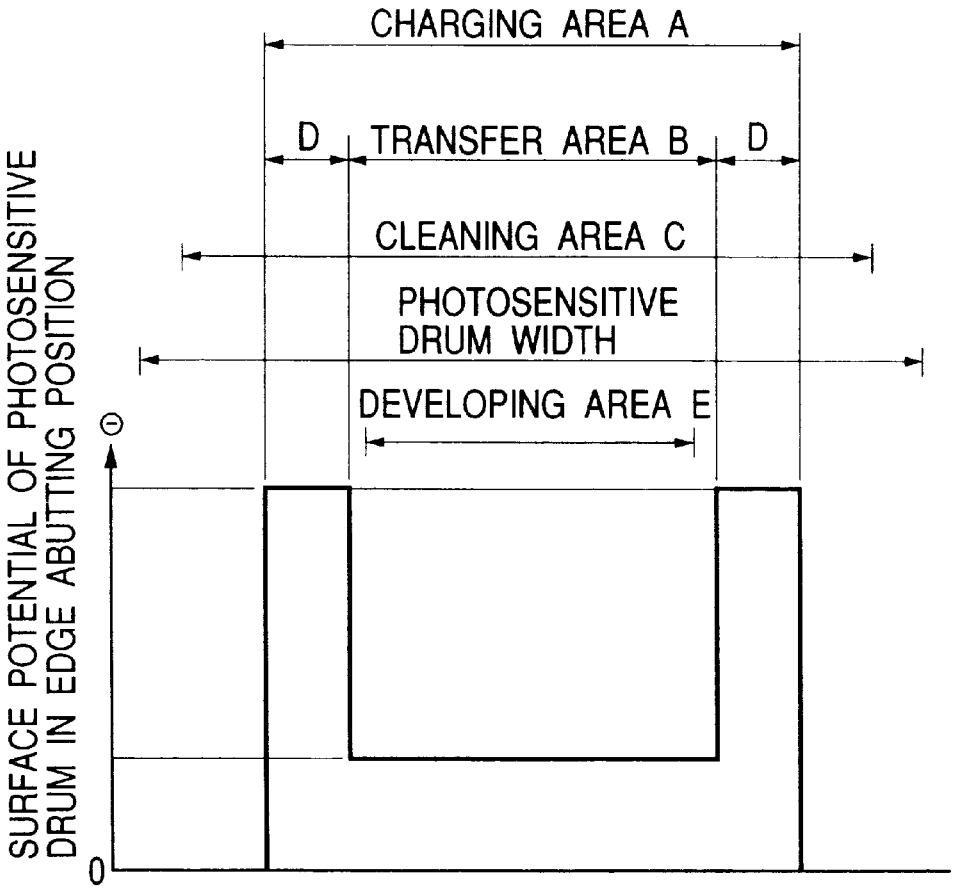
FIG. 2 is a schematic view that shows the relationship of lengths of parts around a photosensitive drum along a longitudinal direction of the photosensitive drum, and surface potentials of the photosensitive drum in an abutting position of a cleaning blade.

FIG. 2 is a view that shows a positional relationship between a charging area A of the charging roller 2, which serves as contact charging means for charging the photosensitive drum 1, transfer area B of the transfer roller 10, a cleaning area C of the cleaning blade 6, and a developing area E of the development sleeve 3 along a longitudinal direction. As to the areas other than the developing area E, the surface potential of the photosensitive drum 1 is also shown in the longitudinal direction.

In accordance with the present embodiment, a polishing member 14, which serves as surface roughing means for making the surface of the photosensitive drum 1 rough, is arranged downstream of the transfer means 10 and upstream of the cleaning means 8 in the rotational direction of the photosensitive drum 1. In other words, this polishing member 14 is arranged downstream of the charging roller 2 that serves as the contact charging means, and upstream of the cleaning means 8. The polishing member 14 is provided with a polishing layer formed by mixing polishing material into elastic material, such as resin or rubber. Then, the polishing member 14 is arranged so that this member 14 is pressed onto the surface of the photosensitive drum 1. Alternatively, it may be possible to attach sand paper or the like around a rotating roller or the like to slightly polish the surface of the photosensitive drum 1 by rotating such roller. In this case, the sand paper may have a roughness of about No. 1000 of JIS regulation or preferably, one which is slightly rougher than this number.

Here, the surface area of the photosensitive drum 1 with which the polishing member 14 is in contact should preferably be an area in which an electrostatic latent image is not developed by the developing means 5 so that no images cannot be formed. Within an area in which images are formed, it is necessary to make the surface roughness (ten-point-average roughness—the same hereinafter) 1 $\mu$m or less, because good images can be no longer obtained if the surface of the photosensitive drum 1 becomes too rough. However, the areas near the end portions of the cleaning blade 6 are those on which no images are formed. Thus, there is almost no problem even if the surface roughness becomes approximately 5 $\mu$m, and the surface roughness is applicable within the range in which the surface layer of the photosensitive drum 1 is not ground too much.

As described above, in accordance with the present invention, it is possible to maintain the surface roughness of the photosensitive member so as not to allow the cleaning blade 6 to be turned up. As a result, good images can be obtained without the turning up of the blade even when the image forming apparatus is used for a long time.

In this respect, in order to prevent the turning up of the cleaning blade in the initial stage of use, the most effective mode is conceivably such that the method disclosed herein is applied in combination with the preliminary coating of the conventional lubricant powder or toner on the cleaning blade or on the surface of the photosensitive drum as has been conventionally practiced.

However, if the image formation method of the so-called reversal development is adopted, the charging means 2 usually charges a wider area than the one where the transfer means 10 is effective. Therefore, as shown in FIG. 2, the area (the area B) that receives the positive charge applied by the transfer means 10 of the area (area A) to which the negative charge is applied by the charging means 2 becomes almost 0V at the time of cleaning. However, the negative charge remains on the area (area D), which receives no positive charge applied by the transfer means 10 even when the area D faces the cleaning blade 6.

On the other hand, the lubricants that reside in the developer in the form of particles are usually charged negative, and rub each other to make a part of the lubricants become positively charged eventually.

The lubricants thus positively charged are attracted to the area D shown in FIG. 2, and then, transferred from the cleansing blade 6 to the surface of the photosensitive drum 1. If this phenomenon advances to cause the lubricants on the cleaning blade 6 to be reduced excessively, the turning up of the blade may occur.

In other words, in order to prevent the cleaning blade 6 from being turned up, it is good enough to produce an effect if the surface should be made rough for at least the portion (the area D) which is outside the transfer area B and within the charging area A of the non-image formation area (outside the developing area E) on the surface of the photosensitive drum 1.

Therefore, particularly for the image forming apparatus that adopts reversal development, it is preferable to apply the surface roughing means of the present invention in combination with the coating of the lubricant for the prevention of the turning up of the cleaning blade than to use the lubricant coating only. With the combined use of the lubricant and the method for making the surface of the photosensitive member rough, it is possible to further enhance the preventive effect against the turning up of the cleaning blade.

Here, in accordance with the present embodiment, the surface roughing means is arranged downstream of the transfer means 10, and upstream of the cleaning blade 6, in the operating direction of the photosensitive drum 1. This arrangement is needed to prevent any possibility that charging becomes defective due to the particles or the like produced by polishing that may adhere to the contact charging means 2. In other words, conditions required for positioning the surface roughing means are satisfied by arranging the surface roughing means upstream of the cleaning blade 6 and downstream of the contact charging means 2 so as not to allow the particles produced by polishing the photosensitive drum 1 to adhere to the contact charging member 2. In this manner, the charging defects are prevented, and the turning up of the cleaning blade is prevented simultaneously.

Particularly, if the surface roughing means 14 is arranged just in front of the cleaning means 8, it becomes possible for the cleaning means 8 to collect the particles that may be produced by polishing before the particles are transferred to some other parts. There is no possibility that the interior of the apparatus is stained by such particles. It is therefore preferable to arrange the surface roughing means downstream of the transfer means and upstream of the cleaning blade 6 as described for the present embodiment.

Second Embodiment

Figure 3:
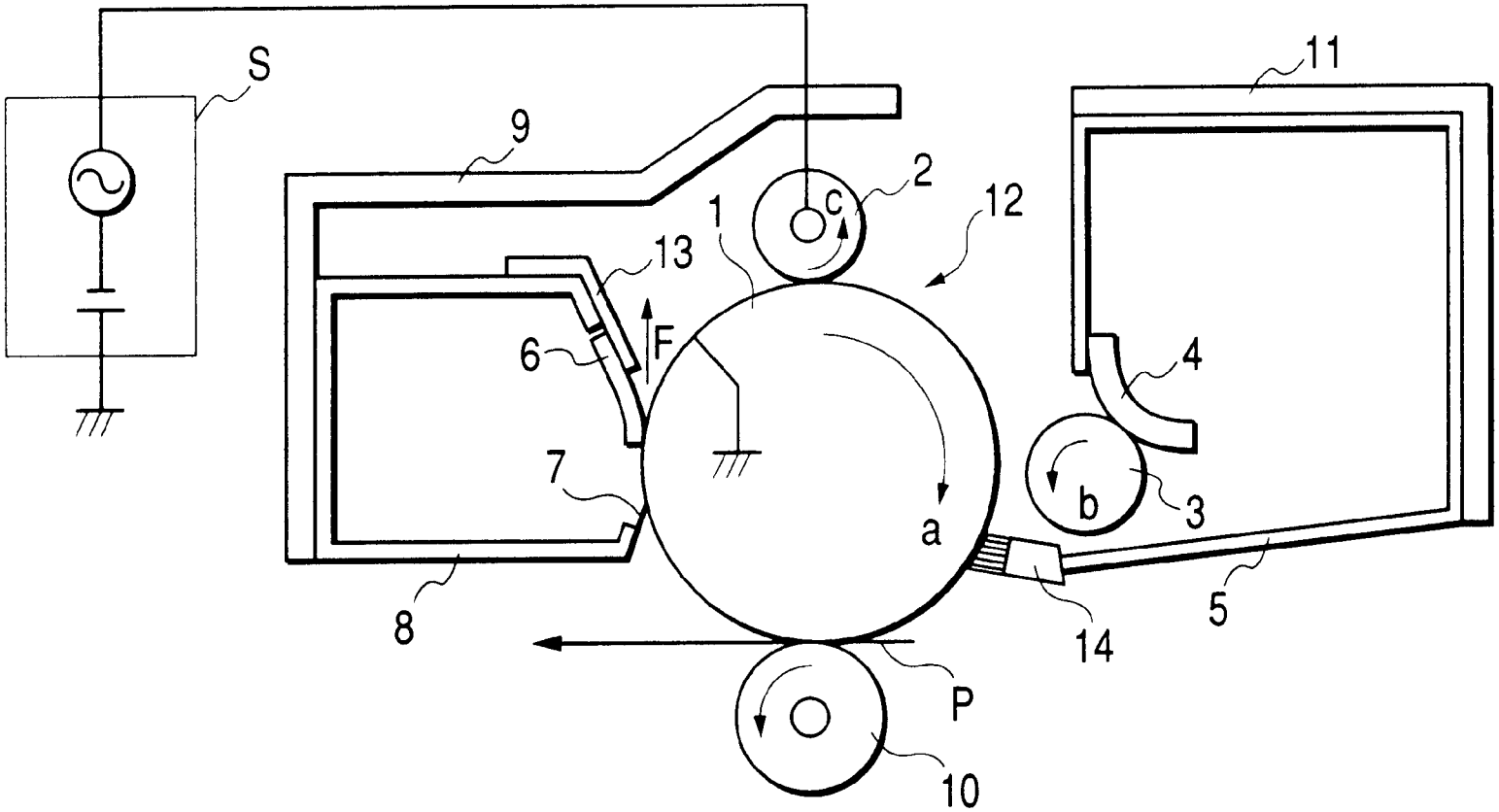
FIG. 3 is a schematic view that shows an image forming apparatus in accordance with another embodiment of the present invention.

Now, in conjunction with FIG. 3, another embodiment will be described in accordance with the present invention.

In accordance with the present embodiment, the surface roughing means 14 is attached to the development container 5 in the process cartridge 11. Each of the devices in FIG. 3, which is designated by the same reference mark as the one appearing in FIG. 1, has the same function as described earlier. Therefore, the detailed description thereof will be omitted here.

In accordance with the present embodiment, the surface roughing means is structured in the container of the process cartridge, which is detachably mountable on the image forming apparatus. As a result, when the cartridge is exchanged, the surface roughing means also becomes new, hence making it possible to maintain the surface roughness constantly for the surface of the photosensitive drum 1 for a long time.

For example, there is a possibility that the performance of the surface roughing means is degraded to make it impossible to anticipate its performance sufficiently. Therefore, it is desirable to make the surface roughing means replaceable. If the surface roughing means is structured together with the cartridge, it becomes possible to obtain a sufficient effect without any extra arrangement that may be required in this respect.

In accordance with the present embodiment, the surface roughing means is installed on the lower part of the development container 5 of the process cartridge, but it may be possible to structure this surface roughing means together with the replaceable cleaning container and other replacement parts around the photosensitive drum if the condition is satisfied that this surface roughing means is arranged downstream of the contact charging means 2 and upstream of the cleaning blade in the operating direction of the photosensitive drum 1.

Third Embodiment

Figure 4:
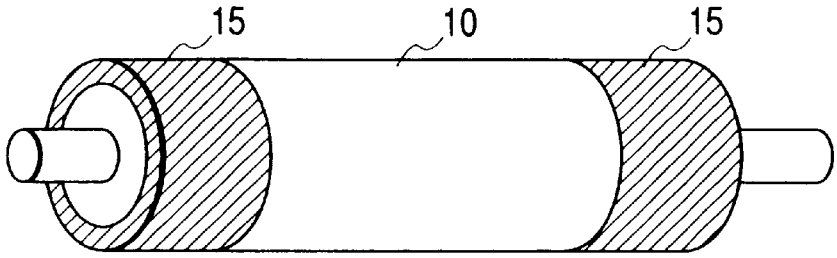
FIG. 4 is a perspective view that shows a transfer roller in accordance with still another embodiment of the present invention.

In conjunction with FIG. 4, a description will be provide of still another embodiment in accordance with the present invention.

For the present embodiment, the surface roughing means 14 is structured coaxially with the transfer roller 10 so that it is made as one part.

In this respect, any other device structures are the same as those appearing in FIG. 1. Here, therefore, only the transfer portion 10 of the transfer roller and the surface roughing portion 15 are shown. The description of other devices will be omitted.

The surface roughing portion of the transfer roller 10 on the outermost layer of the roller, which serves as the surface roughing means, is provided with the layer mixed with the polishing material that can polish the surface of the photosensitive drum 1 or it may be possible to attach the polishing sheet, such as the sandpaper as described earlier, instead of the polishing layer.

In accordance with the present embodiment, there is no need for making any modification, such as the provision of any particular space or any other members anew for installing the surface roughing means. Also, the effect that may be obtainable from this arrangement is the same as the first embodiment. This embodiment is therefore preferably adoptable.

In this respect, the portion of the surface of the photosensitive drum 1 of which the surface layer is made rough has a lower resistance. Then, in order to prevent any excessive electric current from flowing on such portion, the roughed surface of the transfer roller 10 is made sufficiently high resistive or it may be possible to provide a gap of approximately 2 mm between the transfer portion and the roughed surface portion so as not to allow the transfer current to flow on the roughed surface portion.

For the embodiment described above, an electrophotographic photosensitive drum is exemplified as the image bearing member. However, besides the drum type photosensitive member, the belt type photosensitive member is effectively applicable. The embodiment is also applicable to the member, such as an intermediate transfer member of drum type, or belt type that supports a transfer material to be used for a color apparatus.

Also, as charging means, it is exemplified to use the charging member of roller electrode type. However, it may be possible to use also a conductive brush or blade as another configuration thereof. For transfer means, it may be possible to use a blade or corona discharge as in the case of the charging means.

As described above, in accordance with the present invention, the surface roughing means that makes the surface of the image bearing member rough is arranged downstream of the contact charging means and upstream of the cleaning mean in the operating direction of the photosensitive drum. As a result, there is no possibility that charging defect takes place even when contact charging means is used. It is also possible to maintain the preventive effect against the turning up of the cleaning member for a long time.

What is claimed is:

1. An electrophotographic image forming apparatus comprising:

an electrophotographic photosensitive member on which an electrostatic latent image is formed;

charging means structured with an electrode member being in contact with said photosensitive member for forming said electrostatic latent image on said photosensitive member;

cleaning means having a cleaning blade for rubbing and removing toner from a surface of said photosensitive member by contacting a leading edge of said cleaning blade to said photosensitive member in a direction counter to a moving direction of said photosensitive member;

developing means for developing with toner said electrostatic latent image formed on said photosensitive member; and surface roughing means arranged within a cleaning area to which said cleaning blade abuts, outside a developing area in which said developing means performs development, downstream of said charging means and upstream of said cleaning blade in the moving direction of said photosensitive member to abut against said photosensitive member for making the surface of said photosensitive member rough.

2. An electrophotographic image forming apparatus according to claim 1, further comprising transfer means for forming an electric field between a transfer material and said photosensitive member to transfer a developed image on said photosensitive member to said transfer material electrostatically, said transfer means having applied thereto voltage having an opposite polarity to a charging polarity of a charged area charged by said charging means.

3. An electrophotographic image forming apparatus according to claim 2, wherein said surface roughing means is arranged outside a transfer area of said transfer means in a direction perpendicular to the moving direction of said photosensitive member being a width direction of said photosensitive member.

4. An electrophotographic image forming apparatus according to claim 1, wherein said surface roughing means is arranged within a charged area charged by said charging means in a direction perpendicular to the moving direction of said photosensitive member being a width direction of said photosensitive member.

5. An electrophotographic image forming apparatus according to claim 1, wherein said surface roughing means has a polishing layer using polishing material at a surface of said surface roughing means opposite to said photosensitive member.

6. An electrophotographic image forming apparatus according to claim 1, wherein said surface roughing means comprises a polishing sheet attached to a surface of a supporting member.

7. An electrophotographic image forming apparatus according to claim 2, wherein said transfer means is a transfer roller, and said surface roughing means comprises a polishing roller rotatably supported in a vicinity of an end portion of said transfer roller.

8. A process cartridge detachably mountable on an electrophotographic image forming apparatus, said process cartridge comprising:

an electrophotographic photosensitive member on which an electrostatic latent image is formed;

charging means structured with an electrode member being in contact with said photosensitive member to charge said photosensitive member for forming said electrostatic latent image on said photosensitive member;

cleaning means having a cleaning blade for rubbing and removing toner from a surface of said photosensitive member by contacting a leading edge of said cleaning blade to said photosensitive member in a direction counter to a moving direction of said photosensitive member;

surface roughing means arranged within a cleaning area to which said cleaning blade abuts, outside a developing area in which developing means performs development, downstream of said charging means, and upstream of said cleaning blade in the moving direction of said photosensitive member, to abut against said photosensitive member for making the surface of said photosensitive member rough; and a frame for integrally supporting said photosensitive member, said charging means, said cleaning means, and said surface roughing means.

9. A process cartridge according to claim 8, wherein said surface roughing means is arranged within a charged area charged by said charging means in a direction perpendicular to the moving direction of said photosensitive member being a width direction of said photosensitive member.

10. A process cartridge according to claim 8, wherein said surface roughing means has a polishing layer using polishing material at a surface of said surface roughing means opposite to said photosensitive member.

11. A process cartridge according to claim 8, wherein said surface roughing means comprises a polishing sheet attached to a surface of a supporting member.

12. A process cartridge according to claim 8, wherein said process cartridge further supports integrally said developing means for developing with toner said electrostatic latent image on said photosensitive member.

* * * * *

UNITED STATES PATENT AND TRADEMARK OFFICE

CERTIFICATE OF CORRECTION

PATENT NO. : 6,253,044 B1
DATED : June 26, 2001
INVENTOR(S) : Takeo Shoji et al.

It is certified that error appears in the above-identified patent and that said Letters Patent is hereby corrected as shown below:

Title page,
Item [57], ABSTRACT,
Line 9, "counter" should read -- direction counter --.
Line 13, "to" should be deleted.

Column 1,
Line 22, "is" should read -- are --.
Line 39, "transfer" should read -- transferring --.
Line 53, "poly urethane," should read -- polyurethane, --.

Column 2,
Line 34, "near the" should read -- the near --.
Line 41, "end," should read -- end --, and "blade 6" should read -- blade 6, --.
Line 42, "end" should read -- end, --.
Line 66, "that is" should read -- that it is --.

Column 3,
Line 1, "wide" should read -- width --.
Line 15, "laid-Open" should read -- Laid-Open --.
Line 32, "prevent" should read -- prevents --.
Line 45, "potion." should read -- portion. --.

Column 4,
Line 65, "which" should read -- that --.

Column 5,
Line 46, "drum 1," should read -- drum 1. --.

Column 6,
Line 23, "no" should be deleted.
Line 61, "negative," should read -- negatively, --.

UNITED STATES PATENT AND TRADEMARK OFFICE

CERTIFICATE OF CORRECTION

PATENT NO. : 6,253,044 B1
DATED : June 26, 2001
INVENTOR(S) : Takeo Shoji et al.

It is certified that error appears in the above-identified patent and that said Letters Patent is hereby corrected as shown below:

Column 8,
Line 11, "provide" should read -- provided --.
Line 40, "high" should read -- highly --.
Line 62, "mean" should read -- means --.

Signed and Sealed this

Fourteenth Day of May, 2002

*Attest:*

*Attesting Officer*

JAMES E. ROGAN
*Director of the United States Patent and Trademark Office*